US008622444B2

(12) United States Patent
Marko

(10) Patent No.: US 8,622,444 B2
(45) Date of Patent: Jan. 7, 2014

(54) DOOR LATCH MECHANISM

(75) Inventor: Neil L. Marko, Hillsdale, MI (US)

(73) Assignee: Universal Industrial Products, Inc., Pioneer, OH (US)

( * ) Notice: Subject to any disclaimer, the term of this patent is extended or adjusted under 35 U.S.C. 154(b) by 453 days.

(21) Appl. No.: 13/091,687

(22) Filed: Apr. 21, 2011

(65) Prior Publication Data

US 2011/0215600 A1 Sep. 8, 2011

Related U.S. Application Data

(63) Continuation-in-part of application No. 11/741,938, filed on Apr. 30, 2007, now Pat. No. 7,950,703.

(51) Int. Cl.
*E05C 3/14* (2006.01)

(52) U.S. Cl.
USPC ..... 292/336.3; 292/1.5

(58) Field of Classification Search
USPC ..... 292/337, 169, 1.5, 336.3, 163, DIG. 61; 70/107
See application file for complete search history.

(56) References Cited

U.S. PATENT DOCUMENTS

| | | | | |
|---|---|---|---|---|
| 944,534 | A | 12/1909 | Beaman | |
| 2,058,685 | A | 10/1936 | Haan, Jr. | |
| 2,117,192 | A | 5/1938 | McClung | |
| 2,131,458 | A | 9/1938 | Turner | |
| 2,203,341 | A | 6/1940 | Roedding | |
| 2,390,756 | A * | 12/1945 | Voight | 292/169.13 |
| 2,539,083 | A | 1/1951 | Jakeway | |
| 2,705,729 | A | 3/1955 | Jakeway | |
| D204,087 | S | 3/1966 | Adler | |
| 3,544,147 | A * | 12/1970 | James | 292/169 |
| 4,025,094 | A | 5/1977 | Mitchell | |
| 4,038,718 | A | 8/1977 | Reilhac et al. | |
| 4,508,377 | A | 4/1985 | Takasaki et al. | |
| 4,602,490 | A * | 7/1986 | Glass et al. | 70/134 |
| 4,641,866 | A | 2/1987 | Haeck et al. | |
| 4,821,371 | A | 4/1989 | Finkle | |
| 4,852,918 | A * | 8/1989 | Allen | 292/169 |
| 5,020,836 | A * | 6/1991 | Su | 292/165 |
| 5,026,101 | A | 6/1991 | Dotterweich et al. | |
| D319,380 | S | 8/1991 | Politzer et al. | |
| 5,123,687 | A | 6/1992 | Pfeiffer et al. | |
| D331,004 | S | 11/1992 | Birch et al. | |
| 5,259,652 | A * | 11/1993 | Adams et al. | 292/169.14 |
| 5,383,699 | A | 1/1995 | Woziekonski et al. | |
| 5,461,755 | A | 10/1995 | Hardigg et al. | |
| 5,465,462 | A | 11/1995 | Yamada et al. | |
| 5,504,974 | A | 4/1996 | Graber | |
| 5,647,617 | A * | 7/1997 | Kajuch | 292/1.5 |

(Continued)

FOREIGN PATENT DOCUMENTS

| | | |
|---|---|---|
| JP | 2005-263109 | 9/2005 |
| JP | 2008-119009 | 5/2008 |

*Primary Examiner* — Kristina Fulton
(74) *Attorney, Agent, or Firm* — Harness, Dickey & Pierce, P.L.C.

(57) ABSTRACT

The door latch mechanism independently operated by first and second handles of the door handle assembly comprising a cam member having a cam surface which facilitates translation of movement of the handles to displacement of the cam member. The cam member can be coupled to a latch member and move the latch member between an extended and retracted position. A door lock mechanism can prevent displacement of the second door handle while simultaneously allowing displacement of the first door handle.

13 Claims, 7 Drawing Sheets

(56) References Cited

U.S. PATENT DOCUMENTS

| | | | | |
|---|---|---|---|---|
| 6,009,932 | A | 1/2000 | Smith | |
| 6,035,492 | A | 3/2000 | Warshaviak et al. | |
| D423,320 | S | 4/2000 | Kelly et al. | |
| 6,161,899 | A | 12/2000 | Yu | |
| RE37,518 | E | 1/2002 | Hardigg et al. | |
| 6,349,450 | B1 | 2/2002 | Koops et al. | |
| 6,363,577 | B1 | 4/2002 | Spitzley | |
| 6,367,124 | B1 | 4/2002 | Bella et al. | |
| 6,397,435 | B1 | 6/2002 | Gosselet et al. | |
| 6,490,895 | B1 | 12/2002 | Weinerman et al. | |
| D502,641 | S | 3/2005 | Marko | |
| 6,974,163 | B2 * | 12/2005 | Peng et al. | 292/1.5 |
| 7,950,703 | B2 * | 5/2011 | Marko | 292/336.3 |

* cited by examiner

DOOR LATCH MECHANISM

CROSS-REFERENCE TO RELATED APPLICATIONS

This application is a continuation-in-part of U.S. patent application Ser. No. 11/741,938 filed on Apr. 30, 2007. The entire disclosure of the above application is incorporated herein by reference.

FIELD

The present disclosure relates to door handle assemblies and, in particular, to door latch mechanisms for door handle assemblies.

BACKGROUND

The statements in this section merely provide background information related to the present disclosure and may not constitute prior art.

A variety of door handle assemblies are known in the art to selectively secure a door relative to a door frame. In particular, door frame assemblies having push-pull operation are known. However, it would be desirable for a new door handle assembly with push-pull operation having a door latch mechanism providing independent operation of opposing door handles, adjustable translation of door handle motion to latch displacement, and/or a relatively compact configuration.

SUMMARY

The present disclosure provides a door latch mechanism. In some embodiments, the door latch mechanism includes a base having a first channel and a second channel oriented substantially perpendicular to each other and first and second rack components disposed in the first channel. Each of said first and second rack components is independently movable along the first channel. The door latch mechanism further includes a cam member adapted to be coupled to a latch for a door handle assembly. The cam member is disposed in the second channel and is movable along the second channel. The cam member includes a protrusion extending away from the second channel, the protrusion defining a cam surface oblique relative to each of the first and second channels. The door latch mechanism also includes an intermediate component defining an outer surface. The intermediate component is disposed between the first and second rack components with the outer surface engaging the cam surface. Each of the first and second rack components independently moves the intermediate component in a first direction along the first channel toward the cam member to displace the cam member in a second direction along the second channel.

The present disclosure further provides a door handle assembly. In some embodiments, the door handle assembly includes first and second housing components secured on opposing side of a door, first and second handles pivotally coupled to the first and second housing components, respectively, and a latch assembly extending within the door. The latch assembly includes a latch member movable between an extended position outside of the door and a retracted position inside the door. The door handle assembly further has a door latch mechanism extending between the first and second handles within the door. The door latch mechanism includes a base having a first channel and a second channel oriented substantially perpendicular to each other and first and second rack components disposed in the first channel. The first rack component is coupled to the first handle, and the second rack component is coupled to the second handle. Each of the first and second rack components is independently movable along the first channel. The door latch mechanism further includes a cam member coupled to the latch member, the cam member being disposed in the second channel and being movable along the second channel. The cam member includes a protrusion extending away from the second channel, the protrusion defining a cam surface oblique relative to each of the first and second channels. The door latch mechanism also includes an intermediate component defining an outer surface, the intermediate component being disposed between the first and second rack components with the outer surface engaging the cam surface. Each of the first and second rack components independently moves the intermediate component in a first direction along the first channel toward the cam member to displace the cam member in a second direction along the second channel away from the latch assembly. Furthermore, the cam member moves the latch member from the extended position to the retracted position.

The present disclosure also provides a lock assembly that is supported by the first and second housing components and works together with the door latch mechanism and door handle assembly to provide a door locking feature. The lock assembly includes an actuator lever that can be rotated to a lock position and thereby cause a lock pawl to restrict movement of the second rack components as may be desired. The lock assembly can also include an unlock pawl that is operable by the first rack components to rotate door lock assembly to an unlocked position and thereby allow subsequent movement of first rack components.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. It should be noted that some portions of the drawings have been removed for clarity.

Figure 7C:
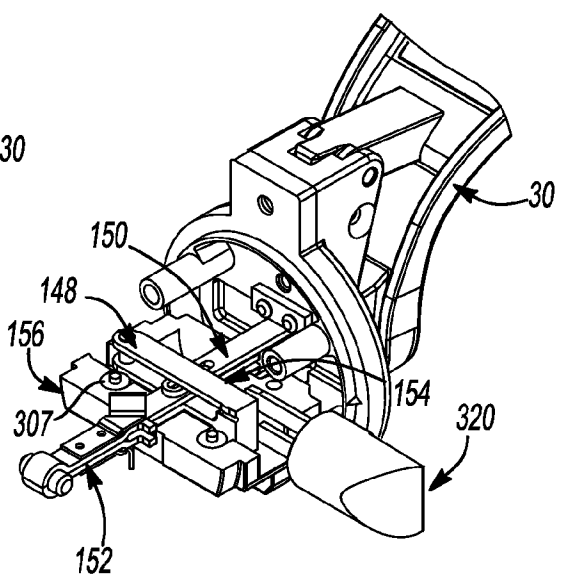
Figure 7B:
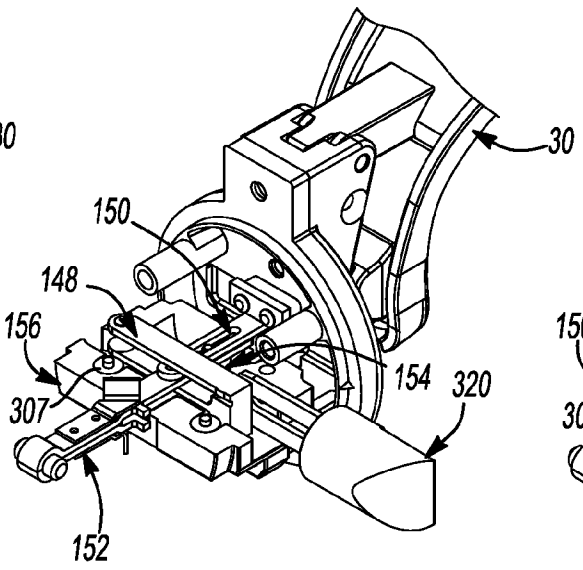
Figure 7A:
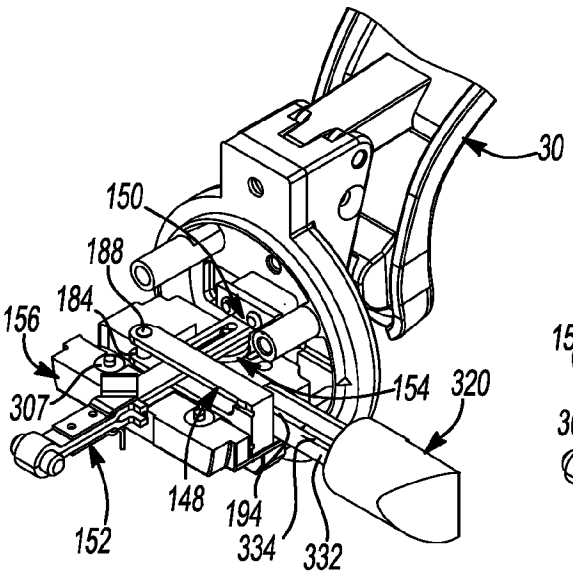
Figure 8C:
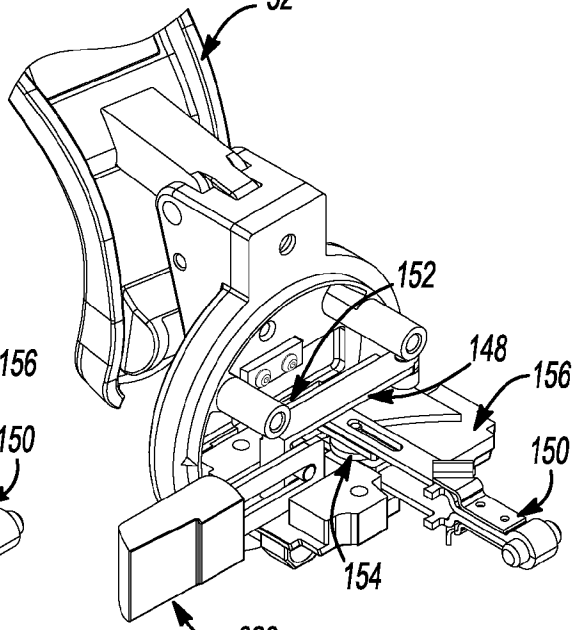
Figure 8B:
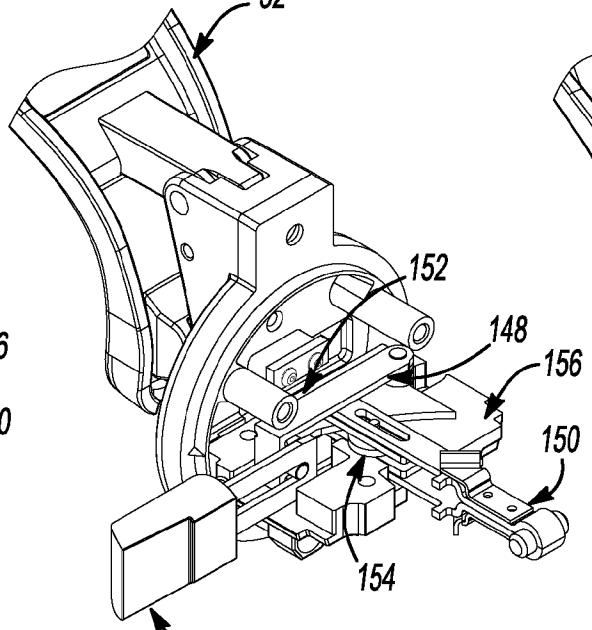
Figure 8A:
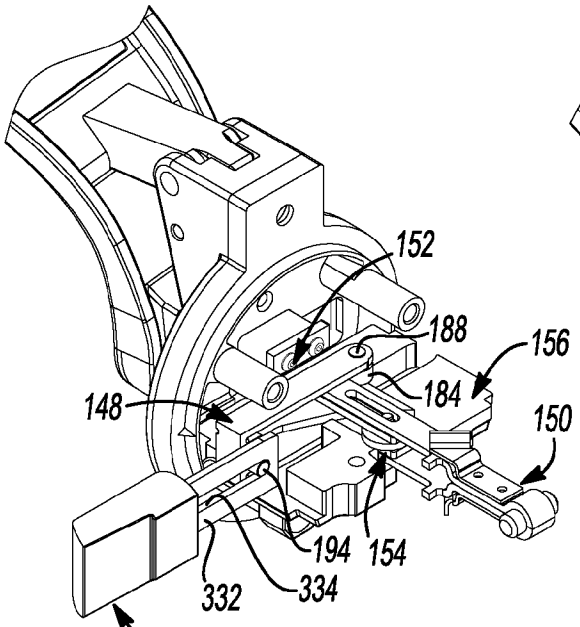

FIGS. 7A-7C are partial perspective views of a door handle assembly according to the principles of the present disclosure illustrating the operation of the door handle assembly with a handle being pulled; and FIGS. 8A-8C are partial perspective views of a door handle assembly according to the principles of the present disclosure illustrating the operation of the door handle assembly with a handle being pushed.

DETAILED DESCRIPTION

The following description is merely exemplary in nature and is not intended to limit the present disclosure, application, or uses. It should be understood that throughout the drawings, corresponding reference numerals indicate like or corresponding parts and features.

According to the principles of the present disclosure, a door handle assembly including a door latch mechanism is provided. In some embodiments, the door latch mechanism can be independently operated by first and second handles of the door handle assembly. The door latch mechanism can include a cam member having a cam surface which facilitates translation of movement of the handles to displacement of the cam member. In some embodiments, the cam member is coupled to a latch member and moves the latch member between an extended and retracted position.

Figure 1:
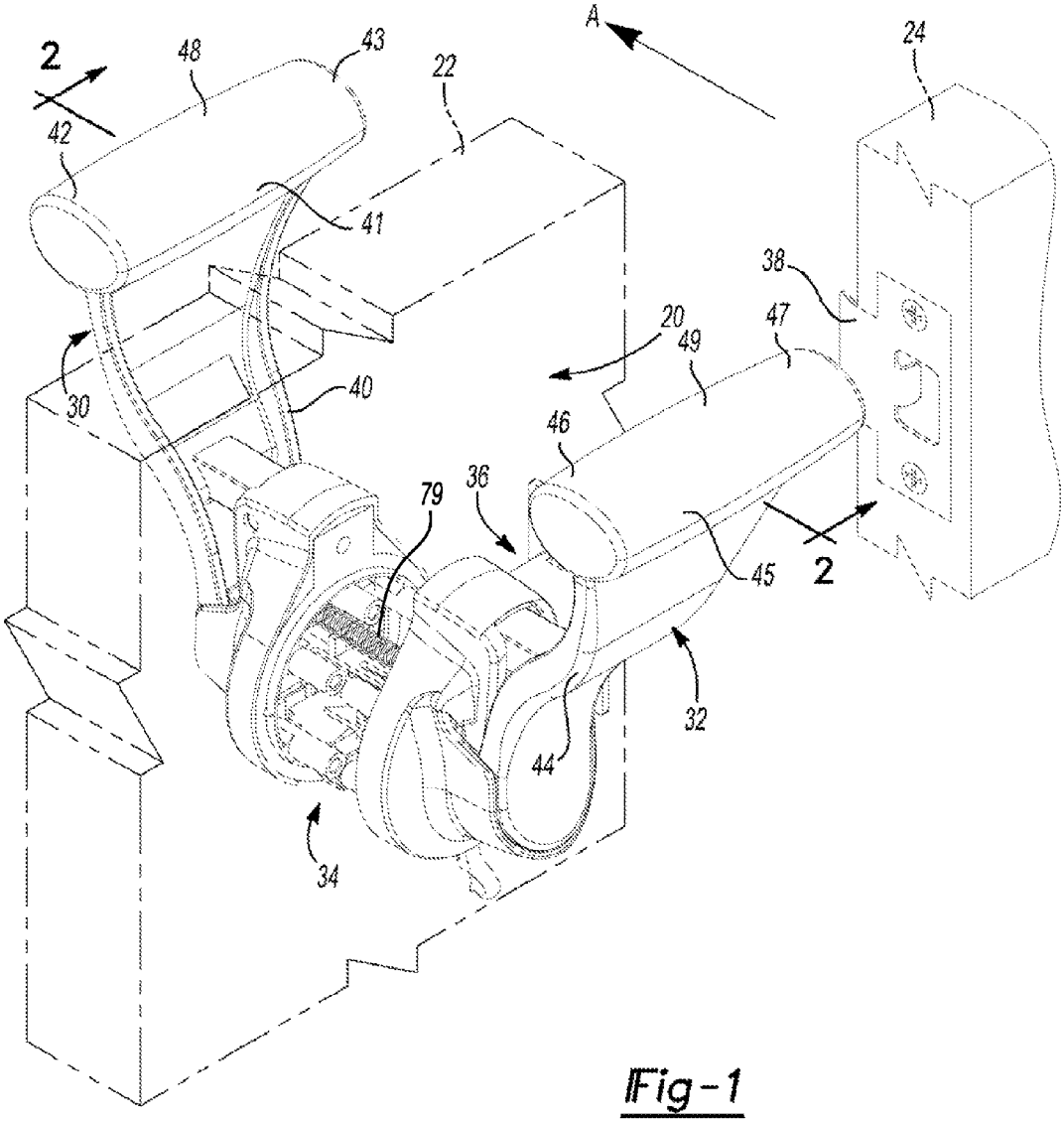
FIG. 1 is a perspective view of a door handle assembly according to the principles of the present disclosure.
Figure 2:
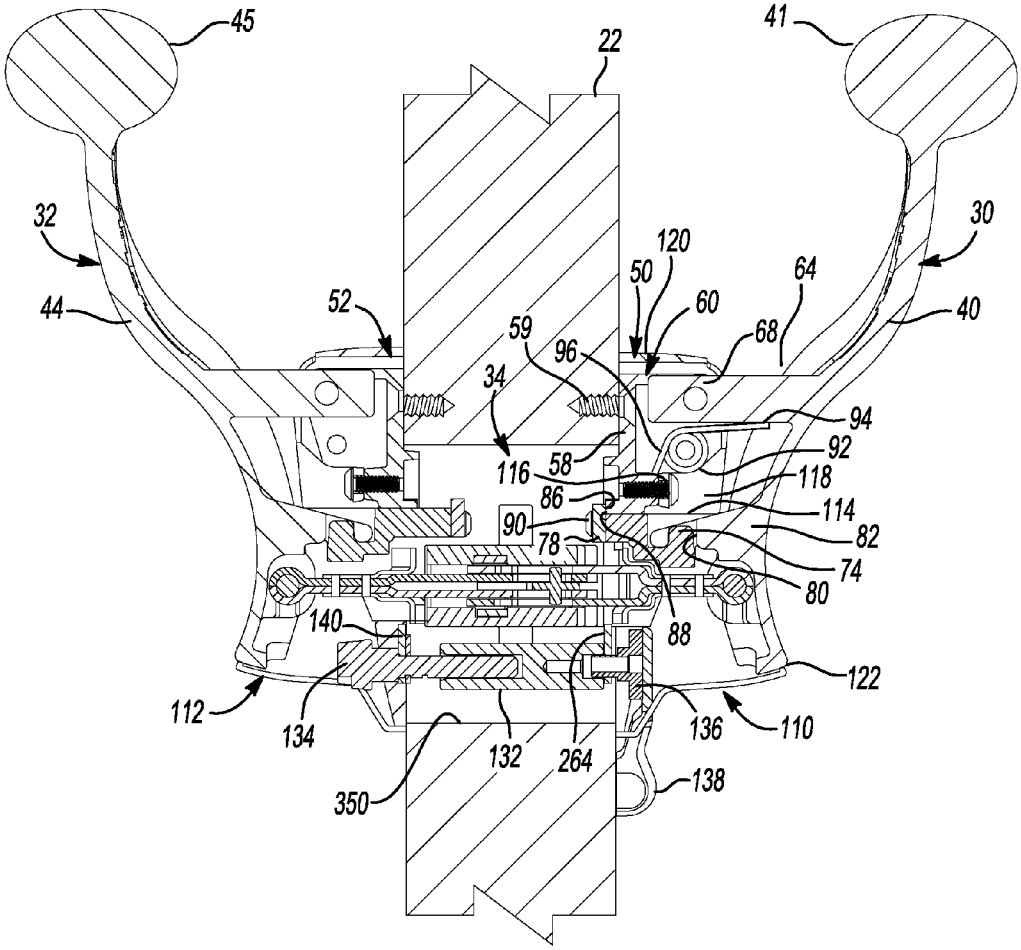
FIG. 2 is a cross sectional view of the door handle assembly along line 2-2 in FIG. 1.
Figure 3:
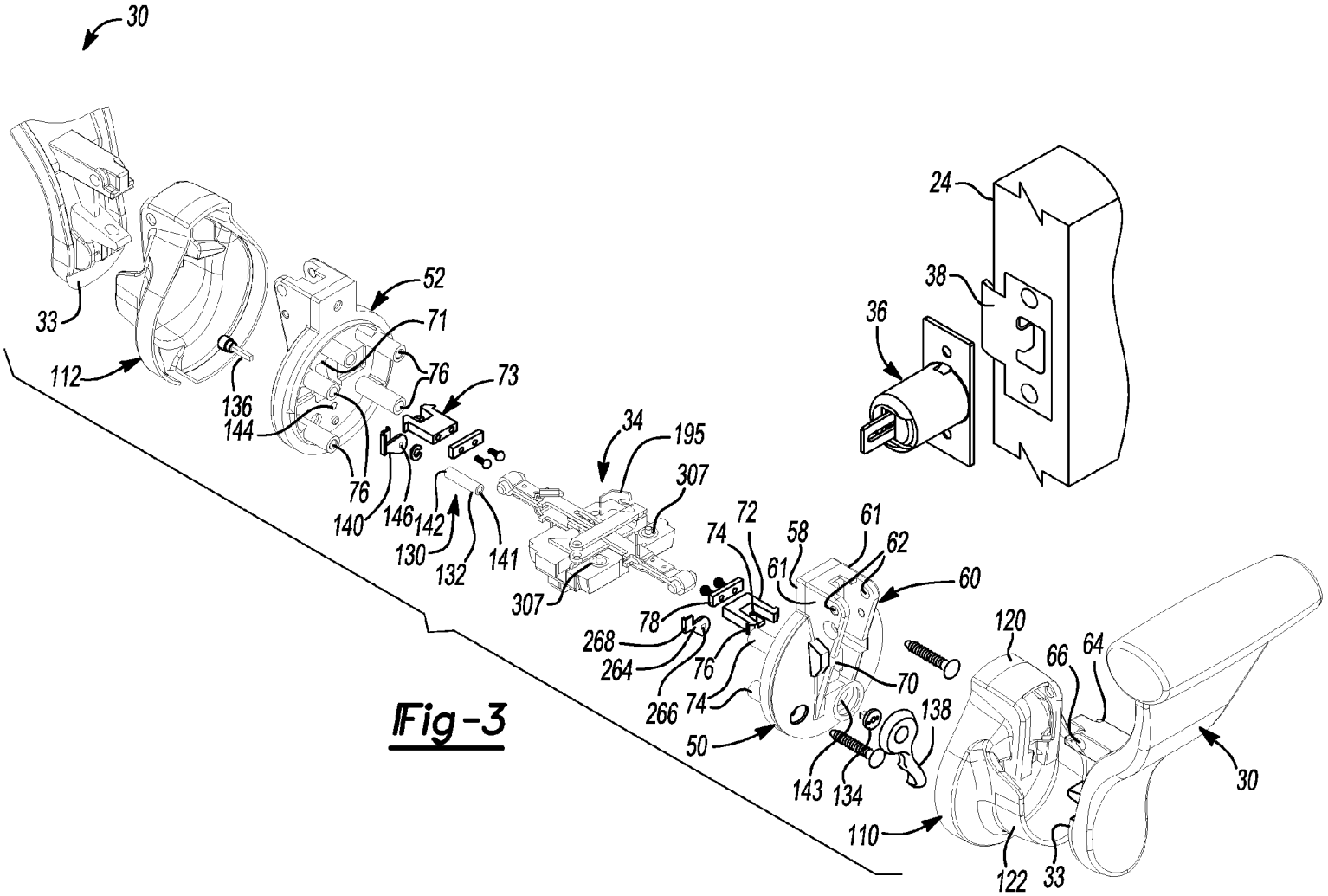
FIG. 3 is an exploded perspective view of a door handle assembly according to the principles of the present disclosure.

Referring to FIGS. 1-3, an exemplary door handle assembly 20 is illustrated according to some embodiments of the present disclosure. Door handle assembly 20 can be coupled to a door 22 and can be operable to selectively secure door 22 relative to a door frame 24. In some embodiments, door handle assembly 20 includes first and second handles 30, 32 on opposite sides of door 22. A door latch mechanism 34 extends through door 22 and is operably coupled to both first and second handles 30, 32. Door latch mechanism 34 is also operably coupled to a latch assembly 36. Latch assembly 36 is configured to engage with a door frame bracket 38 secured to door frame 24.

First and second handles 30, 32 can have similar shapes and configurations. For example, in some embodiments, first handle 30 includes a curved main body 40 and a gripping portion 41 disposed at the top end of main body 40 having a first end 42 and a second end 43. Similarly, in some embodiments, second handle 32 includes a curved main body 44 and a gripping portion 45 disposed at the top end of main body 44 having a first end 46 and a second end 47. Furthermore, in some embodiments, gripping portions 41, 45 can have central regions 48, 49, respectively, that are thicker than the ends thereof. As such, gripping portions 41, 45 can have shapes which correspond to the shape of curved fingers of a hand of an operator grasping one of first and second handles 30, 32. Moreover, it should be understood that first and second handles 30, 32 can have a variety of shapes and configurations. In particular, it should be noted that custom shaped handles for individual applications can be used according to the principles of the present disclosure. In some embodiments, first and second handles 30, 32 can each have a pinch guard 33 (FIG. 3) disposed along a bottom portion thereof to prevent pinching of a user.

In some embodiments of the present disclosure, door handle assembly 20 is configured for push-pull operation, and door 22 opens in one direction relative to door frame 24, as indicated by arrow "A" (FIG. 1). As such, first handle 30 is configured to operate door latch mechanism 34 to disengage latch assembly 36 from door frame bracket 38 when pulled in the "A" direction, and second handle 32 is configured to operate door latch mechanism 34 to disengage latch assembly 36 from door frame bracket 38 when pushed in the "A" direction. This operation is described in further detail herein.

With particular reference to FIGS. 2-3, door handle assembly 20 includes first and second inner housing components 50, 52 attached on opposite sides of door 22. It should be understood that first and second inner housing components 50, 52 have similar configurations arranged in mirrored symmetry. Accordingly, only one of first and second inner housing components 50, 52 will be described in detail herein. Unless otherwise noted, it should be understood that the description of one of first and second inner housing components 50, 52 equally applies to the other.

First inner housing component 50 includes a main body 58 attached to door 22 by a fastener 59 (FIG. 2). Fastener 59 can have a variety of forms. For example, fastener 59 is illustrated as screws in FIG. 2. Second inner housing component is similarly attached to door 22. Furthermore, first inner housing component 50 has a pivot base 60 protruding from main body 58 for pivotally supporting first handle 30. In particular, pivot base 60 includes a pair of spaced-apart sidewalls 61 each having an aperture 62 extending therethrough. Sidewalls 61 are spaced-apart so as to be complementary to a protrusion 64 extending from first handle 30. Protrusion 64 has an aperture 66 (FIG. 3) extending therethrough complementary to apertures 62 (FIG. 3). A pin 68 can extend through apertures 62 and aperture 66 to pivotally couple first handle 30 to first inner housing component 50. Second handle 32 can be similarly pivotally coupled to second inner housing component 52.

In some embodiments, first and second inner housing components 50, 52 can further include axially extending guide channels 70, 71 for slidably supporting first and second stop links 72, 73. First stop link 72 can be coupled with first handle 30 and work together with first inner housing component 50 to define a range of rotation of first handle 30 as first handle 30 is rotated away from the home position. Similarly, second stop link 73 can be coupled with second handle 32 and work together with second housing component 52 to define a range of rotation of second handle 32. It should be understood that first and second stop links 72, 73 can have similar configurations arranged in mirrored symmetry. Accordingly, only first stop link 72 will be described in detail herein. Unless otherwise noted, it should be understood that the description of first stop link 72 applies equally to second stop link 73.

In some embodiments, first stop link 72 can include a link stud 74, a back stop face 76, and a forward stop 78. Link stud 74 can be located on one end of first stop link 72 and positioned within a complementary aperture 80 formed within an actuator arm 82 formed in first handle 30. Back stop face 76 can be located on the same end of first stop link 72 as link stud 74 and adapted to engage an outboard face 84 of first inner housing component 50 when first handle 30 is at the home position. Forward stop 78 can be located on an opposite end of link stud 74 and can include a forward stop face 86 that is adapted to engage an inboard face 88 of first inner housing component 50 when the door latch mechanism 34 is in the retracted position as will be described. Forward stop 78 can be coupled to first stop link 72 by screw fasteners 90 as shown in FIG. 2.

According to the principles of the present disclosure, a biasing member 92 (FIG. 2) can be coupled to first inner housing component 50. In some embodiments, biasing member 92 is a torsion spring pivotally coupled to pivot base 60 of first inner housing component 50 having distal ends 94, 96 engaged with first handle 30 and pivot base 60, respectively, to bias first handle 30 towards the home position. It should be appreciated that a second biasing member (not shown) can be similarly coupled to second inner housing component 52 and engaged with second handle 32 to bias second handle 32 towards the home position shown in FIG. 2. Still further, it should be understood that in some embodiments, a coil spring 79 (FIG. 1) can be disposed between first handle 30 and/or second handle 32 to provide a robust biasing force urging first handle 30 and/or second handle 32 into the home position.

In some embodiments, first and second inner housing components 50, 52 can each include a plurality of inwardly extending boss features 100, 102 respectively. Boss features 100, 102 can be complementarily positioned on first and second inner housing components 50, 52 so that first and second inner housing components 50, 52 can be secured to each other.

In some embodiments, door handle assembly 20 further includes first and second outer housing components or covers 110, 112 disposed over first and second inner housing components 50, 52, respectively. As with first and second inner housing components 50, 52, first and second outer housing components 110, 112 can have similar configurations, and, accordingly, only one of first and second inner housing components 50, 52 will be described in detail herein. Unless otherwise noted, it should be understood that the description of one of first and second outer housing components 100, 102 equally applies to the other.

First outer housing component 110 can have an aperture 114 complementary to a boss feature 116 in first inner housing component 50. A fastener 118 can extend through aperture 114 and engage boss feature 116 to secure first outer housing component 110 to first inner housing component 50. Second outer housing component 112 can be similarly secured to second inner housing component 52. Furthermore, first outer housing component 110 can include a cover portion 120 extending over pivot base 60 and a concave cup portion 122 formed complementary to the bottom portion of first handle 30. Second outer housing component 112 can include similar features. As such, first and second outer housing components 110, 112 can function to protect the components of door handle assembly 20 and can provide a desired appearance of door handle assembly 20.

Additionally, in some embodiments, inner housing components 50, 52 support a lock assembly 130 (FIGS. 2-3) operable to lock door handle assembly 20. Lock assembly 130 can include a connector shaft 132, first and second lock shafts 134, 136, an actuator lever 138, and a lock pawl 140. Connector shaft 132 can extend between first and second inner housing components 50, 52 and can be supported on opposite ends by first and second lock shafts 134, 136. First and second lock shafts 134, 136 are each slidably received within keyed apertures 141, 142 located at respective ends of connector shaft 132. First and second lock shafts 134, 136 extend through and can be rotatably supported by bores 143, 144 that are formed in first and second inner housing components 50, 52, respectively. Actuator lever 138 can be coupled to a distal end of first lock shaft 134 and can extend through outer housing component 110. Lock pawl 140 can be disposed between connector shaft 132 and inner housing component 52 and can be operably connected to second lock shaft 136. Specifically, second lock shaft 136 can extend through a keyed opening 146 in lock pawl 140. In this manner, actuator lever 138 can be actuated to cause lock pawl 140 to engage door latch mechanism 34 to lock door handle assembly 20 as will be described.

It should be understood that, in some embodiments, second outer housing component is not associated with a similar locking feature so that door handle assembly 20 can only be locked or unlocked from a single side of door 22.

Door latch mechanism 34 (FIG. 3) of door handle assembly 20 can be supported between first and second inner housing components 50, 52 and can be operably coupled to both first and second handles 30, 32 and latch assembly 36. In particular, as described in more detail herein, door latch mechanism 34 can operate latch assembly 36 to a retracted position in response to either the pulling of first handle 30 or the pushing of second handle 32.

Figure 4:
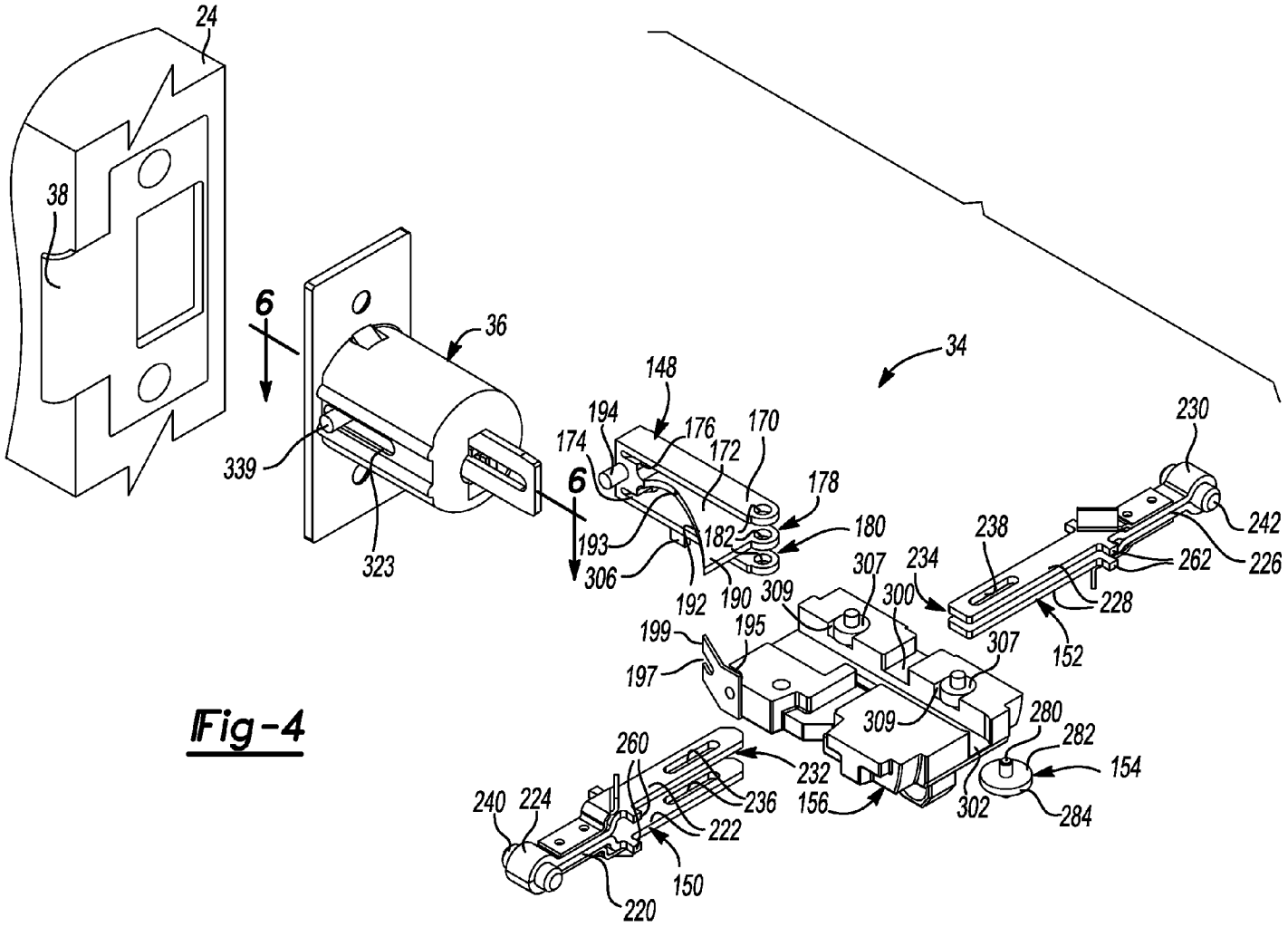
FIG. 4 is an exploded perspective view of a door latch mechanism, latch assembly, and door frame bracket according to the principles of the present disclosure.
Figure 5:
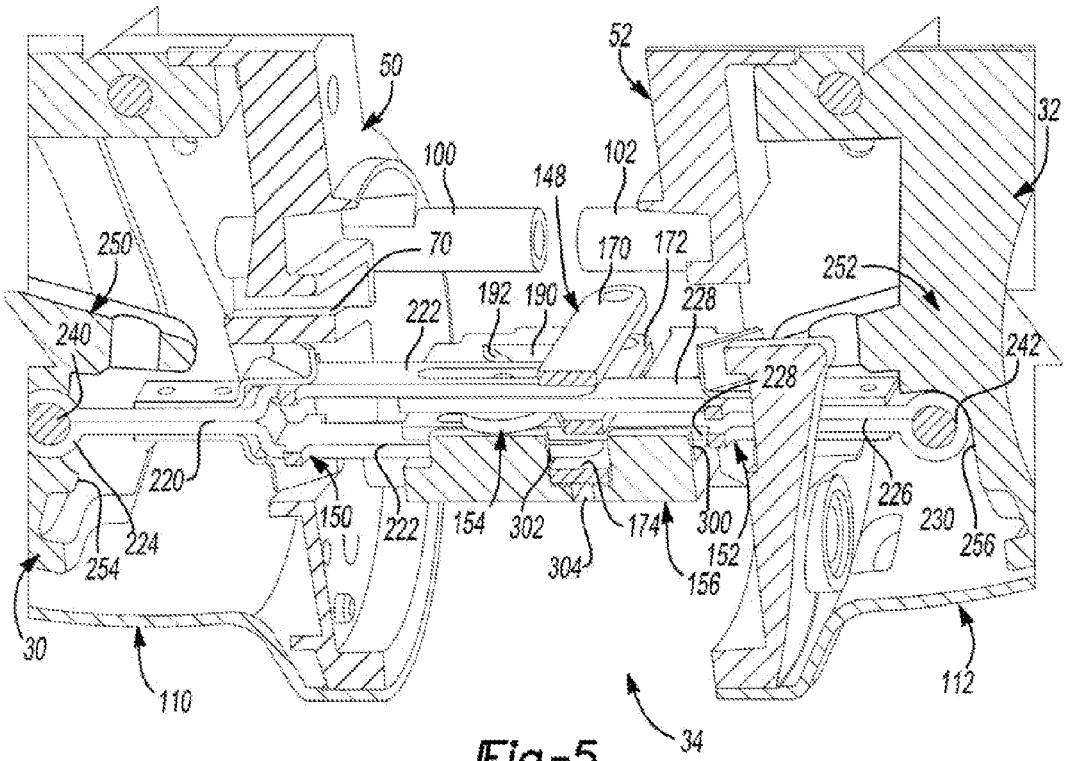
FIG. 5 is a cross sectional view of a door latch mechanism according to the principles of the present disclosure.

Referring in particular to FIGS. 4-5, door latch mechanism 34 is illustrated in detail according to some embodiments of the present disclosure. Door latch mechanism 34 includes a cam member 148 coupled to latch assembly 36, first and second rack components 150, 152 coupled to first and second handles 30, 32, respectively, and an intermediate component or roller 154 operably disposed between cam member 148 and first and second rack components 150, 152. Door latch mechanism 34 also includes a base 156 secured between first and second inner housing components 50, 52 and supporting cam member 148, first and second rack components 150, 152, and roller 154.

Cam member 148 includes a top section 170, a middle section 172, and a bottom section 174 extending substantially parallel to each other from a base section 176. As such, a top gap 178 (FIG. 4) can be defined between top section 170 and middle section 172, and a bottom gap 180 (FIG. 4) can be defined between middle section 172 and bottom section 174. Furthermore, each of top, middle, and bottom sections 170, 172, 174 can include an aperture 182 (FIG. 4) disposed opposite base section 176. A top spacer 184 (FIGS. 7A, 8A) can be disposed in top gap 178 proximate apertures 182. A bottom spacer (not shown) can be disposed in bottom gap 180 proximate apertures 182. A fastener 188 (FIGS. 7A, 8A), e.g. a pin, can extend through apertures 182 and into the spacers to secure cam member 148 and the spacers together.

In some embodiments, cam member 148 can further include a protrusion 190 extending from one side middle section 172. Protrusion 190 has a generally triangular shape and defines an arcuate cam surface 192. As described in further detail herein, cam surface 192 and roller 154 engage and translate the movement of first and second handles 30, 32 to the operation of latch assembly 36. In particular, in some embodiments, cam surface 192 can have a generally concave shape including a concave end portion 193 (FIG. 4) configured to receive roller 154.

Additionally, in some embodiments, cam member 148 can include a post 194 (FIGS. 4, 7A, 8A) extending outwardly from base section 176. As described in further detail herein, post 194 can couple cam member 148 to latch assembly 36. A clip member 195 (FIGS. 3 and 4) can be used such that it extends over post 194 and latch assembly 36 to maintain proper engagement of post 194 with latch assembly 36 during operation. Clip member 195 is intended to remain spaced apart from latch assembly 36 and post 194 until such time as latch assembly 36 starts to become disengaged from post 194 whereby clip member 195 will prevent lateral movement sufficient to fully disengage post 194 from latch assembly 36. Clip member 195, in some embodiments, can comprise an angular member mounted to base 156 having a slot 197 formed therein to permit post 194 to travel therebetween during operation, however the distal ends 199 of clip member 195 will engage latch assembly 36 if disengagement of latch assembly 36 and post 194 begins.

With continued reference to FIGS. 4-5, in some embodiments, first and second rack components 150, 152 of door latch mechanism 34 can have similar tuning fork-type configurations. For example, first rack component 150 can include a base section 220 and a pair of elongate prongs 222 extending away from base section 220 substantially parallel to each other. First rack component 150 can further include a cylindrical end section 224 extending from base section 220 opposite prongs 222. Similarly, second rack component 152 can include a base section 226 and a pair of elongate prongs 228 extending away from base section 226 substantially parallel to each other. Second rack component 152 can further include a cylindrical end section 230 extending from base section 226 opposite prongs 228.

Prongs 222, 228 can be spaced-apart so as to define gaps 232, 234 (FIG. 4) therebetween. In some embodiments, gap 232 of first rack component 150 can be larger than gap 234 of second rack component 152. As such, first rack component 150 can extend over second rack component 152 such that prongs 222 sandwich prongs 228 with a clearance therebetween. Furthermore, gap 234 can be large enough so that prongs 228 of second rack component 152 sandwich middle section 172 of cam member 148 with a clearance therebetween. Additionally, in some embodiments, prongs 222 each include a slot 236 (FIG. 4) therein, and prongs 228 each include a slot 238 (FIG. 4) therein. As described in more detail below, roller 154 is also disposed between prongs 222, 228 and extends into slots 236, 238.

In some embodiments, first and second rack components 150, 152 further include pins 240, 242 supported within cylindrical end sections 224, 230, respectively. Pins 240, 242 can engage coupling features 250, 252 (FIG. 5) of first and second handles 30, 32, respectively. For example, pin 240 of first rack component 150 can be disposed within a U-shaped slot 254 (FIG. 5) of coupling feature 250. With this configuration, movement of first handle 30 is translated to first rack component 150. However, pin 240 can slide along slot 254 so that rotation of first handle 30 only causes movement of first rack component 150 along the length thereof. As such, the rotation of first handle 30 does not displace first rack component 150 out of position. The further operation of door handle assembly 20 is described in more detail herein. Pin 242 of second rack component 152 can be disposed within a U-shaped slot 256 (FIG. 5) of coupling feature 252 and can have a similar interaction with second handle 32.

Additionally, in some embodiments, first rack component 150 can include a pair of locking tabs 260 disposed on opposing sides of base section 220, and second rack component can include a pair of locking tabs 262 disposed on opposing sides of base section 226 (FIG. 4). Locking tabs 260, 262 can work together with lock assembly 130 to lock and unlock door handle assembly 20. In some embodiments, door handle assembly 20 can be locked by rotating actuator lever 138 towards a lock position. Rotating actuator lever 138 can cause lock pawl 140 to rotate towards locking tabs 262. In the locked position, lock pawl 140 can be located at a position adjacent locking tabs 262 so that lock pawl 140 prohibits translational movement of second rack component 152 as second handle 32 is rotated away from the home position. Conversely, door handle assembly 20 can be unlocked by rotating actuator lever 138 towards an unlock position, causing lock pawl 140 to be located at a position away from locking tabs 262 such that second rack component 152 can translate in response to the rotation of second handle 32.

In some embodiments, lock assembly 130 can further include an unlock pawl 264 to automatically unlock door handle assembly 20 as second handle 32 is rotated away from the home position. Referring to FIGS. 2-3, unlock pawl 264 can be disposed between connector shaft 132 and inner housing component 50 and can be operably connected to first lock shaft 134. Specifically, first lock shaft 134 can extend through a keyed opening 266 in unlock pawl 264. In this manner, actuator lever 138 can be actuated to cause unlock pawl 264 to rotate between a lock and unlock position in same manner as previously described for lock pawl 140. In the lock position, unlock pawl 264 can be located at a position adjacent locking tabs 260 such that the translational movement of first rack component 150 corresponding to rotating first handle 30 away from the home position can cause locking tabs 260 to engage a cam face 268 (FIG. 3) of unlock pawl 264. First handle 30 can be rotated further to cause locking tabs 260 to impart a force on cam face 268 and thereby rotate lock assembly 130 towards the unlock position. In this manner, unlock pawl 264 can work together with first rack component 150 to permit door handle assembly 20 to be unlocked by rotating first handle 30.

It should be appreciated that due to the symmetrical arrangement of first and second inner housing components 50, 52 and locking tabs 260, 262, first and second inner housing components 50, 52 and lock assembly 130 can be installed in an opposite arrangement to that shown in FIGS. 1-3 to lock door handle assembly 20. Accordingly, lock assembly 130 can be used to prohibit translational movement of first rack component 150 as first handle 30 is rotated away from the home position and to allow translational movement of second rack component 152 to unlock door handle assembly 20 as second handle 32 is rotated away from the home position.

With particular reference to FIG. 4, in some embodiments, roller 154 of door latch mechanism 34 can have a tiered cylindrical shape. For example, roller 154 can include a rod portion 280 and a disk portion 282 extending from rod portion 280. Rod portion 280 can have a smaller diameter than disk portion 282. In some embodiments, rod portion 280 extends into slots 236, 238 of first and second rack components 150, 152. Furthermore, in some embodiments, disk portion 282 defines an outer surface 284 which engages cam surface 192 of cam member 148. In particular, in some embodiments, roller 154 is disposed with disk portion 282 sandwiched between prongs 228 of second rack component 152, which are sandwiched between prongs 222 of first rack component 150, so that rod portion 280 extends into slots 236, 238 and outer surface 284 engages cam surface 192. As described in further detail herein, roller 154 can function as an intermediate component between cam member 148 and first and second rack components 150, 152 to translate movement of the rack components in a first direction to displacement of the cam member in a second direction substantially perpendicular to the first direction.

Referring again to FIGS. 4-5, base 156 of door latch mechanism 34 can include first and second channels 300, 302 formed therein. In some embodiments, first and second channels 300, 302 are oriented substantially perpendicular to each other. First channel 300 can support and guide first and second rack components 150, 152, and second channel 302 can support and guide cam member 148. Furthermore, in some embodiments, second channel 302 can include a groove 304 (FIG. 5) therein complementary to a tab 306 (FIG. 4) extending from bottom section 174 of cam member 148. Groove 304 and tab 306 can engage to help guide and align cam member 148 in second channel 302. Furthermore, in some embodiments, door latch mechanism 34 can include one or more bearings 307 disposed within bearing slots 309 adjacent first channel 300 and/or second channel 302 (shown) to enhance smooth operation of the door handle assembly 20.

Figure 6:
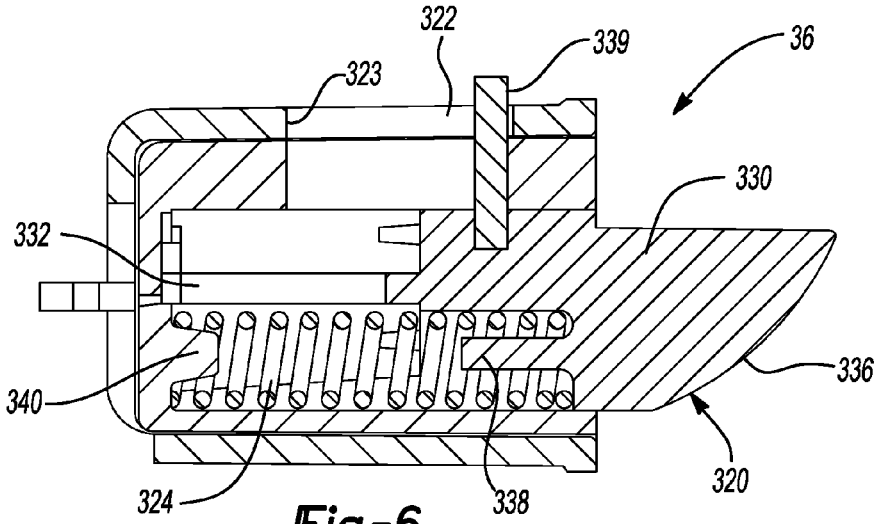
FIG. 6 is a cross sectional view of the latch assembly along line 6-6 in FIG. 4.

Referring to FIG. 6, latch assembly 36 of door handle assembly 20 can include a latch member 320 disposed in a housing 322. Furthermore, a biasing member 324 can be disposed between latch member 320 and housing 322. In some embodiments, latch member 320 includes a main section 330 and a coupling section 332 extending therefrom. Coupling section 332 can have a slot 334 formed therein which receives post 194 of cam member 148 (FIGS. 7A, 8A). As such, cam member 148 and latch member 320 can be coupled and, thus, door latch mechanism 34 and latch assembly 36 can be coupled. Furthermore, in some embodiments, main section 330 of latch member 320 includes a sloped outer surface 336 and a protrusion 338 formed therein. Biasing member 324 can be coupled between protrusion 338 and a protrusion 340 of housing 322. As illustrated in FIG. 6, biasing member can be in the form of a coil spring. Furthermore, in some embodiments, a stop member 339, such as a pin, can engage main section 330 and operably contact a portion of housing 322 (through a slot 323) to serve as a device to limit the motion of main section 330. In this way, latch assembly 36 can be essentially self-contained and capable of being modularly inserted and/or removed without complete disassembly.

Referring to FIGS. 7-8, the operation of door handle assembly 20 according to some embodiments of the present disclosure is illustrated. In particular, FIGS. 7A-7C illustrate that door latch mechanism 34 can operate to retract latch member 320 in response to the pulling of first handle 30. Furthermore, FIGS. 8A-8C illustrate that door latch mechanism 34 can also operate to retract latch member 320 in response to the pushing of second handle 32.

In FIG. 7A, first handle 30 is in a home position. Furthermore, latch member 320 is in an extended position, and roller 154 is positioned proximate the end of cam member 148 opposite latch member 320. As first handle 30 is pulled (FIG. 7B), the bottom portion of first handle 30 moves closer to the housing components, and first rack component 150 moves inwardly. The ends of slots 236 engage rod portion 280 of roller 154 and pushes roller 154 in a first direction along first channel 300 of base 156 toward cam member 148. As outer surface 284 of roller 154 is engaged with cam surface 192 of cam member 148 and as cam member 148 is disposed in second channel 302, cam member 148 is displaced in a second direction substantially perpendicular to the first direction along second channel 302 while roller 154 moves relative to cam surface 192. In particular, roller 154 rolls on outside surface 284 along cam surface 192. Cam member 148 is displaced away from latch member 320 along second channel 302 so that the pulling of first handle 30 retracts latch member 320. When roller 154 moves into engagement with concave end portion 193 of cam surface 192 (FIG. 7C), latch member 320 is in a fully retracted position.

As first rack component 150 pushes roller 154, roller 154 moves within slot 238 of second rack component 152. Furthermore, as first and second rack components are independently supported in first channel 300, second rack component 152 and second handle 32 are not affected by the pulling of first handle 30.

Additionally, it should also be understood that, according to some embodiments of the present disclosure, pushing first handle 30 does not operate door latch mechanism 34. In particular, if first handle 30 is pushed, first rack component 150 moves away from cam member 148, and roller 154 merely moves along slots 236. As such, door handle assembly 20 can be configured so that first handle 30 is only functional in a single direction, such as in correspondence with the direction of movement of door 22 as illustrated in FIG. 1.

In FIG. 8A, second handle 32 is in a home position, such as illustrated in FIG. 2. Furthermore, latch member 320 is in an extended position, and roller 154 is positioned proximate the end of cam member 148 opposite latch member 320. As second handle 32 is pushed (FIG. 8B), the bottom portion of second handle 32 moves away from the housing components, and second rack component 152 moves outwardly. The ends of slots 238 engage rod portion 280 of roller 154 and pulls roller 154 in the same first direction along first channel 300 of base 156 toward cam member 148. As outer surface 284 of roller 154 is engaged with cam surface 192 of cam member 148 and as cam member 148 is disposed in second channel 302, cam member 148 is displaced in the same second direction substantially perpendicular to the first direction along second channel 302 while roller 154 moves relative to cam surface 192. In particular, roller 154 rolls on outside surface 284 along cam surface 192. Cam member 148 is displaced away from latch member 320 along second channel 302 so that the pulling of second handle 32 retracts latch member 320. When roller 154 moves into engagement with concave end portion 193 of cam surface 192 (FIG. 8C), latch member 320 is in a fully retracted position.

As second rack component 152 pulls roller 154, roller 154 moves within slot 236 of first rack component 150. Furthermore, as first and second rack components are independently supported in first channel 300, first rack component 150 and first handle 30 are not affected by the pushing of second handle 32.

Additionally, it should also be understood that, according to some embodiments of the present disclosure, pulling second handle 32 does not operate door latch mechanism 34. In particular, if second handle 32 is pulled, second rack component 152 moves away from cam member 148, and roller 154 merely moves along slots 238. As such, door handle assembly 20 can be configured so that second handle 32 is only functional in a single direction, such as in correspondence with the direction of movement of door 22 as illustrated in FIG. 1.

As described herein, the interaction of cam member 148 and roller 154 can translate the motion of first and second handles 30, 32 to the displacement of latch member 320. According to some embodiments of the present disclosure, cam surface 192 can be shaped to limit or otherwise set this relation between the amount of motion of first and second handles 30, 32 and the retraction of latch member 320. For example, cam surface 192 can be shaped so that second handle 32 only has to be pushed a small amount to retract latch member 320. By way of non-limiting example, cam surface 192 and first and second handles 30, 32 can be configured so that only ½ inch of motion of either of first and second handles 30, 32 retracts latch member 320. As such, door handle assembly 20 can provide clearance between gripping portion 45 of second handle 32 and door 22 during operation and prevent the pinching of a hand of an operator between second handle 32 and door 22. It should be understood that cam surface 192 can be shaped in a variety of ways for a variety of applications of door handle assembly 20.

The operation of latch assembly 36 is well known in the art and, as such, will not be described in detail herein. Furthermore, door frame bracket 38 of door handle assembly 20 is configured to engage with latch member 320 of latch assembly 36 as is well known in the art. Additionally, in some embodiments, when latch assembly 36 is engaged with door frame bracket 38, lock assembly 130 can be operated to lock door 22 relative to door frame 24. Additionally, lock assembly 130 can be configured to automatically disengage when first handle 30 is pulled.

With particular reference to FIG. 2, in some embodiments, many of the components of door latch mechanism 34 can be disposed within an aperture 350 of door 22. As such, door handle assembly 20 can be configured for operation with a variety of doors having a variety of sizes. By way of non-limiting example, door handle assembly 20 can be used with doors having thicknesses from 1 & ⅜ inches to 2 inches.

The present disclosure can vary in many ways. A door handle assembly and a door latch mechanism according to the principles of the present disclosure can have a variety of components and configurations not limited to those discussed in detail herein. The components described herein can have a variety of shapes and configurations and can be made of a variety of materials. Accordingly, it should be understood that the present disclosure is exemplary in nature.

What is claimed is:

1. A door latch mechanism operably coupled to a door for selectively securing the door relative to a door frame, the door latch mechanism comprising:

a latch assembly having a latch member positionable between an extended position engaging the door frame and a retracted position being spaced apart from the door frame;

a first rack component being movable in at least a first direction, said first rack component having a first slot;

a second rack component being movable in at least said first direction, said second rack component having a second slot;

a cam member having a cam surface, said cam member being movable in a second direction, said second direction being generally perpendicular to said first direction, said cam member being operably coupled to said latch member for selective movement therewith;

an intermediate component having an outer surface engagable with said cam surface, said intermediate component being slidably received within said first slot and said second slot such that linear actuation of at least one of said first rack component and said second rack component causes said intermediate component to cam along said cam surface thereby linearly moving said latch member from said extended position to said retracted position; and a lock pawl being positionable in a lock position and an unlock position, said lock pawl inhibiting movement of said first rack component in said lock position and permitting movement of said first rack component in said unlock position.

2. The door latch mechanism of claim 1, further comprising:

an unlock pawl coupled to said lock pawl, said unlock pawl having a cam surface; and a tab extending from said second rack component, said tab cammingly engaging said cam surface of said unlock pawl during movement of said second rack component in said first direction thereby moving said lock pawl from said lock position to said unlock position.

3. The door latch mechanism of claim 1, wherein said first rack component includes a pair of first prongs extending along said first direction, said first prongs being spaced apart and disposed around said cam member, and said second rack component includes a pair of second prongs extending along said first direction, said second prongs being spaced apart and disposed around said cam member, said second prongs being disposed between said first prongs and said cam member.

4. The door latch mechanism of claim 3, wherein said first prongs each include a first slot extending along said first direction, said second prongs each include a second slot extending along said first direction, and said intermediate component is disposed between said first and second prongs and extends into said first and second slots, said intermediate component moving relative to one of said first and second rack components along one of said first and second slots when the other of said first and second rack components moves said intermediate component.

5. The door latch mechanism of claim 4, wherein said intermediate component has a rod portion extending into said first and second slots and a disk portion defining said outer surface, said disk portion being disposed between said first and second prongs adjacent said cam member.

6. The door latch mechanism of claim 1, wherein said cam surface has an arcuate shape.

7. The door latch mechanism of claim 1, wherein said cam surface has a concave shape.

8. The door latch mechanism of claim 1, further comprising:

at least one bearing member engaging at least one of said first rack component and said second rack component.

9. The door latch mechanism of claim 1, further comprising:

a stop member extending from said latch member, said stop member engaging a latch member housing in said extended position.

10. A door latch mechanism operably coupled to a door for selectively securing the door relative to a door frame, the door latch mechanism comprising:

a latch assembly having a latch member positionable between an extended position engaging the door frame and a retracted position being spaced apart from the door frame;

a first rack component being linearly movable in at least a first direction, said first rack component having a first slot;

a second rack component being linearly movable in at least said first direction, said second rack component having a second slot;

a cam member having a cam surface, said cam member being linearly movable in a second direction, said second direction being generally perpendicular to said first direction, said cam member being operably coupled to said latch member for selective movement therewith; and an intermediate component engaging said cam surface, said intermediate component being slidably received within said first slot and said second slot such that linear actuation of at least one of said first rack component and said second rack component causes said intermediate component to cam along said cam surface thereby linearly moving said latch member from said extended position to said retracted position.

11. The door latch mechanism of claim 10, wherein said cam surface has an arcuate shape.

12. The door latch mechanism of claim 10, wherein said cam surface has a concave shape.

13. The door latch mechanism of claim 10, further comprising:

at least one bearing member engaging at least one of said first rack component and said second rack component.

* * * * *